US006460937B2

(12) United States Patent
Seear et al.

(10) Patent No.: US 6,460,937 B2
(45) Date of Patent: Oct. 8, 2002

(54) METHOD OF LONGWALL PANEL DEVELOPMENT

(75) Inventors: Peter Kenneth Seear; Bret Edward Leisemann, both of Brisbane (AU)

(73) Assignee: Cutting Edge Technology Pty Ltd., Queensland (AU)

( * ) Notice: Subject to any disclaimer, the term of this patent is extended or adjusted under 35 U.S.C. 154(b) by 0 days.

(21) Appl. No.: 09/739,037

(22) Filed: Dec. 18, 2000

(65) Prior Publication Data

US 2001/0006304 A1 Jul. 5, 2001

(30) Foreign Application Priority Data

Dec. 17, 1999 (AU) ..... PQ4720
Jun. 8, 2000 (AU) ..... PQ8062

(51) Int. Cl.[7] ..... E21C 41/18
(52) U.S. Cl. ..... 299/18; 299/19
(58) Field of Search ..... 299/10, 18, 64, 299/68, 19, 95

(56) References Cited

U.S. PATENT DOCUMENTS 2,859,953 A * 11/1958 Joy ..... 299/18
4,118,072 A * 10/1978 Kelley et al. ..... 299/31
4,378,132 A * 3/1983 Spies et al. ..... 299/11
5,129,502 A * 7/1992 Justice ..... 198/303

FOREIGN PATENT DOCUMENTS

SU 0724736 * 3/1980

OTHER PUBLICATIONS

Hartman, H. (Senior Ed.), SME Mining Engineering Handbook, 1992, 2nd Edition, pp1559,1560,1696.*

* cited by examiner

*Primary Examiner*—Heather Shackelford
*Assistant Examiner*—John Kreck
(74) *Attorney, Agent, or Firm*—Ladas & Parry

(57) ABSTRACT

A method of roadway development for longwall mining The method includes using a continuous mining machine (100) from which there rearwardly extends a conveyor (102). As the machine (100) progresses to form a road, the conveyor (102) extends. At the rear extremity of the conveyor (102) a roadway development auger mining machine (103) receives mined material from the conveyor (102) and delivers it to a further conveyor (104). A transverse auger (106) also conveys material from the parallel roadway to the machine (103). Mined material is delivered to the auger (106) by a further machine (101) and conveyor (107).

10 Claims, 16 Drawing Sheets

METHOD OF LONGWALL PANEL DEVELOPMENT

TECHNICAL FIELD

The present invention relates to mining, in particularly longwall mining,

BACKGROUND OF THE INVENTION

Longwall mining is one of three underground coal mining methods typically used. A seam of coal which can be suitably mined using longwall mining is typically 1 to 6 meters in thickness and may extend at an angle to the horizontal. To enable coal to be mined using the longwall method, a seam of coal is typically divided into a number of elongated rectangular blocks by forming a network of roads throughout the seam. The roads typically include a series of parallel roads. The roads are typically straight, although their height varies according to variation in thickness of the seam of coal, The roads are formed so that their height, where possible, is equivalent to or less than the thickness of the seam of coal.

Referring to FIG. 1, the network of roads typically includes roads A1 and B1 and a series of approximately parallel roads 1, 2, 3, 4 . . . n which are approximately normal to roads A1 and B1. Road A1 can include any number of adjacent, parallel roads and is formed first. Roads 1 and 2 are then developed and the development of road B1 usually follows the development of roads 1 and 2. The development of roads 3 and 4 are typically positioned close to each other as are roads 1 and 2. Roads 2 and 3 are typically separated by a much larger distance to define an elongated rectangular block of coal, namely block A of FIG. 1. Although the network of roads typically includes pairs of closely positioned, approximately parallel roads, 1 and 2, 3 and 4 etc, a network of roads can include a repeating pattern of up to 5 or more closely positioned, approximately parallel roads which are separated by a sufficient distance to span the width of Blocks A, B etc.

Block A is mined using a longwall shearer which repeats a cycle involving moving a small distance from road B1 (the top of Block A as viewed in FIG. 1) toward road A1, and subsequent lateral movement of a plough shear or rotatable cutting drum across the coal face which spans the width of Block A. As the shearer moves from road B1 toward road A1, it mines block A with the use of the plough shear or rotatable cutting drum which moves across coal face, cutting coal from the longwall face of block A. The separation distance of roads 2 and 3 is therefore determined by the maximum lateral movement of the longwall shearer.

Roads 1, 3, 5 etc are developed to provide alternative escape routes in the event of an emergency situation. The roads also deliver a continuous supply of air to dilute methane gas. The profile of roads 1, 3, 5 etc is typically the same as that of roads 2, 4 and 6. As can be seen from FIG. 1, roads 5 and 6 are spaced apart from roads 3 and 4 the same distance that roads 3 and 4 are spaced apart from 1 and 2 to create elongated rectangular block B, which has approximately the same width as elongated rectangular block A. The process of developing roads is repeated to create a series of adjacent elongated rectangular blocks.

Roads 1–n are typically formed using a Continuous Mining Machine (CMM) in combination with a Shuttle Car (SC) and a Conveyor Belt (CB). In the case of a series of pairs of roads, 1 and 2, 3 and 4 etc, as shown in FIG. 1, a pair of adjacent roads is usually developed together with a single CMM. The process of creating pairs of roads is typically the same for each pair of roads. For ease of explanation, roads 1 and 2 will be referred to throughout the specification; however, the reference 1 and 2 applies equally to any of the pairs of roads, 1 and 2, 3 and 4, 5 and 6 etc of FIG. 1 and also applies to a pair of adjacent roads which form part of a number of closely positioned, approximately parallel roads in road development systems that include more than one alternative escape route and air passageway. A conveyor belt (CB) is assembled in road 2 to extend along the longitudinal length of road 2 as it is being developed and hence extended by the CMM. Coal which is mined from the CMM is transferred to the CB by a SC. Each pair of roads is developed so that lateral roads link roads 1 and 2. The lateral roads are also formed by the CMM and are typically developed by mining, with the CMM, from road 2 to road 1. One method typically used to develop roads 1 and 2 and the lateral roads is as follows:

(a) The CMM mines road 2 so that it extends beyond the end of road 1 and a recently formed lateral road, with the SC making frequent trips between the CMM and the end of the conveyor.

(b) The CMM then retraces its path along road 2 until it reaches the most recently formed lateral road and moves to road 1 via this lateral road and subsequently mines road 1 so that its blind end is approximately laterally positioned relative to the blind end of road 2.

(c) The CMM then crosses over to road 2 to develop a lateral road which extends between blind ends of roads 1 and 2.

(d) The CMM then retraces its path along the most recently formed lateral road until it reaches road 2.

As the above cycle is repeated, an end of the CB which is closest to the CMM is moved along the length of road 2 to follow the CMM as it mines and hence extends road 2. However, the CB is not extended beyond a lateral hole until the next lateral hole is developed. The SC constantly moves between the CMM and the SB, as the CMM develops roads 1 and 2 and the lateral roads.

The efficiency and hence productivity of the CMM is greatly reduced by any movement of the CMM in the above described steps a–d which is not for the purpose of extending roads 1 or 2 or the lateral roads. That is, any movement between roads 1, 2 or the lateral roads, as well as any movement which requires the CMM to retrace its path, has a substantial negative impact on the productivity of the CMM. Because the productivity of longwall mining is limited by the speed with which the roads are created, it is desirable to provide a more efficient method of roadway development for longwall mining. It is therefore also desirable to provide apparatus suitable for implementing an improved method of roadway development.

OBJECT OF THE INVENTION

It is the object of the present invention to overcome or substantially ameliorate at least one of the above disadvantages.

SUMMARY OF THE INVENTION

The present invention provides a method of roadway development for longwall mining comprising the steps of:

(a) developing first and second substantially parallel roads;

(b) joining first and second roads with lateral tunnels which extend laterally between the first and second roads and are positioned at predetermined distances along the longitudinal length of the first and second roads; and (c) transporting material mined in the process of developing the first road to the second road, via one of the lateral tunnels for transportation along the second road and subsequently out of the mine.

The step of joining the first and second roads with lateral tunnels preferably comprises the steps of:

(a) forming a blind hole which extends laterally from the second road; and (b) extending the first road to intersect a blind end of the blind hole to result in the lateral road joining the first and second roads.

The second road is therefore preferably developed ahead of the first road so that lateral tunnels, which extend from the second road, do not intersect the first road until the first road is subsequently developed or extended. The subsequent development of the first road results in the first road intersecting a recently formed lateral tunnel. The material mined in the process of developing the-first road is preferably transported, via a lateral tunnel which is closest to an end of the first road which is being mined. An auger which may be used to transport material which is mined in the process of developing the first road, to the second road is therefore preferably moved along the first road in the direction in which the first road is being developed or extended, to more recently developed lateral tunnels which are closer to the end of the first road which is being mined. However, the auger cannot be moved to a more recently developed lateral tunnel until the first road has been extended sufficiently beyond the more recently developed lateral tunnel to permit both the equipment which is being used to develop the first road and the auger to be appropriately positioned along the first road.

The step of developing the first and second roads preferably comprises independently developing the first and second roads with independent mining equipment.

The blind holes arc preferably formed with the use of an auger or drill.

The material mined from the first road is preferably transported to the second road via an auger.

Independent continuous mining machines (CMM) may be used to develop the first and second roads. Material mined in the process of developing the first road may be transported to the auger via a shuttle car. Material mined in the process of developing the second road is preferably transported out of the mine via a conveyor which extends down the length of the second road. The conveyor is preferably periodically extended to extend along the length of the second road as the second road is developed. The material transported from the first road to the second road, via the auger, is preferably deposited onto the conveyor.

Movable conveyor means may be used to transport material which is mined in the process of developing the second road to the conveyor. The movable conveyor means may comprise a movable conveyor, one end of which is fixed relative to the mining equipment which develops the second road and the other end of which is movable relative to the conveyor, the movable conveyor being positioned above the conveyor and adapted to extend along part of the length of the conveyor which is proximal the end of the second road which is being mined, so that movement of the movable conveyor along the second road with development of the second road results in movement of the movable conveyer relative to the conveyer and the depositing of mined material from a depositing end of the movable conveyor onto the conveyer. When the depositing end of the movable conveyor approaches the end of the conveyor which is proximal the end of the second road which is being mined, the conveyor is extended along the second road which is being mined, and the movable conveyor is repositioned along the length of the conveyor to enable the movable conveyor to again be moved along the second road while depositing mined material, via the depositing end of the movable conveyor, onto the conveyor.

The auger which may be used to transport material which is mined in the process of developing the first road, to the second road, may be substantially equivalent to the drill or auger which is used to form the lateral tunnels.

The present invention in a preferred form also provides movable conveyor means having a first portion which is arranged to receive material which has been mined by mining equipment which develops underground roadways, and a second portion which is arranged for movement relative to a stationary conveyor and depositing of a mined material received from the mining equipment onto a surface of the stationary conveyor which is adapted to convey material along the longitudinal length of the stationary conveyor.

The movable conveyor means may comprise a chain and/or belt conveyor(s) having a longitudinal axis which is arranged for substantial alignment with the longitudinal axis of the stationary conveyor wherein the conveyor is arranged for movement relative to the stationary conveyor in a direction which is substantially aligned with the longitudinal axis of the conveyor. The first and second portions of the movable conveyor means may comprise first and second ends respectively of a conveyor or two or more associated conveyors which are arranged to move relative to a stationary conveyor upon movement of mining equipment. The mining equipment may comprise a continuous mining machine (CMM) and an associated drill or auger which is adapted to drill holes laterally relative to a road which the CMM is developing.

The present invention in a preferred form also provides a drill or auger apparatus comprising a drill or auger string respectively, pumping means for pumping a gas, and transport means for transporting the pumped gas to a blind end of a hole which is being drilled by the drill or auger string, wherein the pumping means, in combination with the transport means, is adapted to pump a gas from a driven end of the drill or auger string, via the transport means, to a blind end of the hole.

The drill or auger string may comprise hollow stem auger flights and an associated cutter head wherein the pumping means, in combination with the hollow stem auger flights, is adapted to pump a gas from a driven end of the hollow stem auger flights, through the hollow stem of the hollow stem auger flights, and out of the hollow stem at an end of the hollow stem which is proximal the cutter head.

The pumping means may be adapted to pump air to the cutter head end of hollow stem auger flights for the purpose of diluting methane gas to non explosive levels.

The apparatus may further include gas detection means for detecting the levels of methane gas at an end of a hole which is drilled by the apparatus which is adjacent the driven end of the apparatus.

The gas detection means may be adapted to automatically shut down the drill or auger apparatus if the gas detection means detects hazardous levels of methane. The gas detection means may comprise a methanomitor.

The pumping means preferably comprises a pump which is attached to a hollow stem of the hollow stem auger flights, via sealing means. The sealing means may comprise a seal which is adapted to seal two rotatably engagable members.

A further method is disclosed herein, the method being a method of roadway development for longwall mining comprising:

(a) developing a first road by use of a first continuous mining machine;

(b) delivering mined material from the first machine to a first longitudinally extendable first conveyor extending rearwardly from the first machine;

(c) delivering the material from the first conveyor to a second conveyor via which mined material from the first road is delivered from the first road;

(d) developing a second road by use of a second continuous timing machine, the second road being substantially parallel to the first road;

(e) delivering the mined material from the second machine to a longitudinally extendable third conveyor extending rearwardly from the second machine, (f) delivering the mined material from the third conveyor to a transverse auger conveyor extending between the first and second roads so that mined material from the third conveyor is delivered to the second conveyor.

In a modification of the above method, a shuttle car conveys material from the second continuous miner to the third conveyor.

In a further modified form of the above method, the third conveyor is replaced with a shuttle car that conveys material from the second continuous miner to the auger conveyor.

In a still modified form of the above method, the first conveyor is replaced with a shuttle car that conveys material from the first continuous miner to be delivered to the second conveyor.

In the above described methods preferably the auger conveyor is provided by an auger mining machine via which material is conveyed to the second conveyor and to which mined material is delivered from the first and second mining machines.

There is still further disclosed herein a method of roadway development for longwall mining comprising:

(a) developing a first road by use of a first continuous mining machine;

(b) delivering mined material from the first machine to a first conveyor;

(c) developing a second road by use of a second continuous mining machine, the second road being substantially parallel to the first road;

(d) delivering mined material from the second mining machine by an auger conveyor to said first conveyor; and (e) the material from said second mining machine being delivered to said auger conveyor by means of a shuttle car.

Preferably in the above method the auger conveyor is provided by an auger mining machine, to which material from said first machine is directly delivered to be conveyed to said first conveyor.

In the preceeding summary of the invention, except where the context requires otherwise, due to express language or necessary implications, the words "comprising", "comprises", or "comprise" are used in the sense of "including", that is the features specified may be associated with further features in various embodiments of the invention.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENTS

Figure 1:
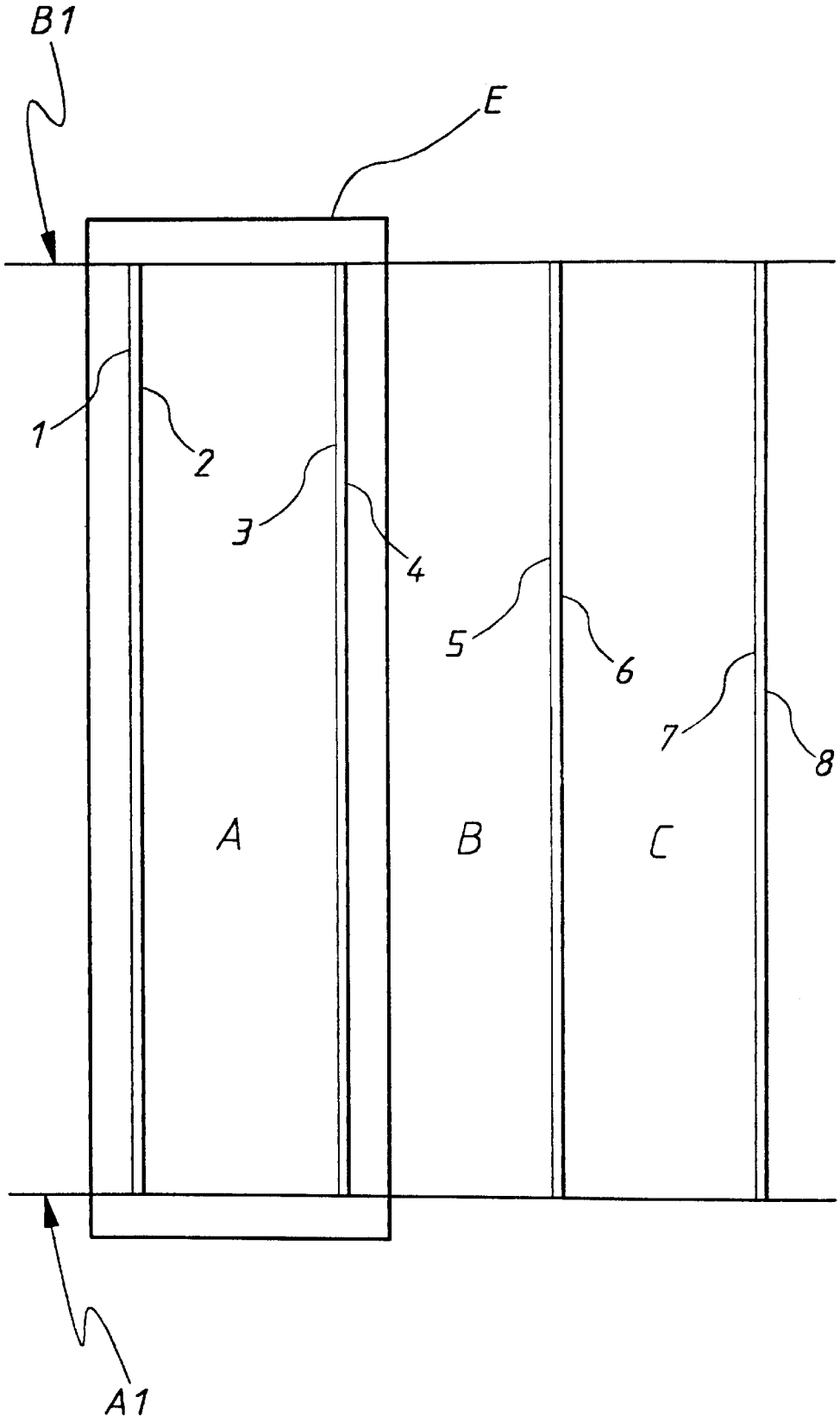
FIG. 1 is a plan view of a system of underground roads used to divide a seam of coal into a number of elongated rectangular blocks A, B, C, . . .
Figure 2:
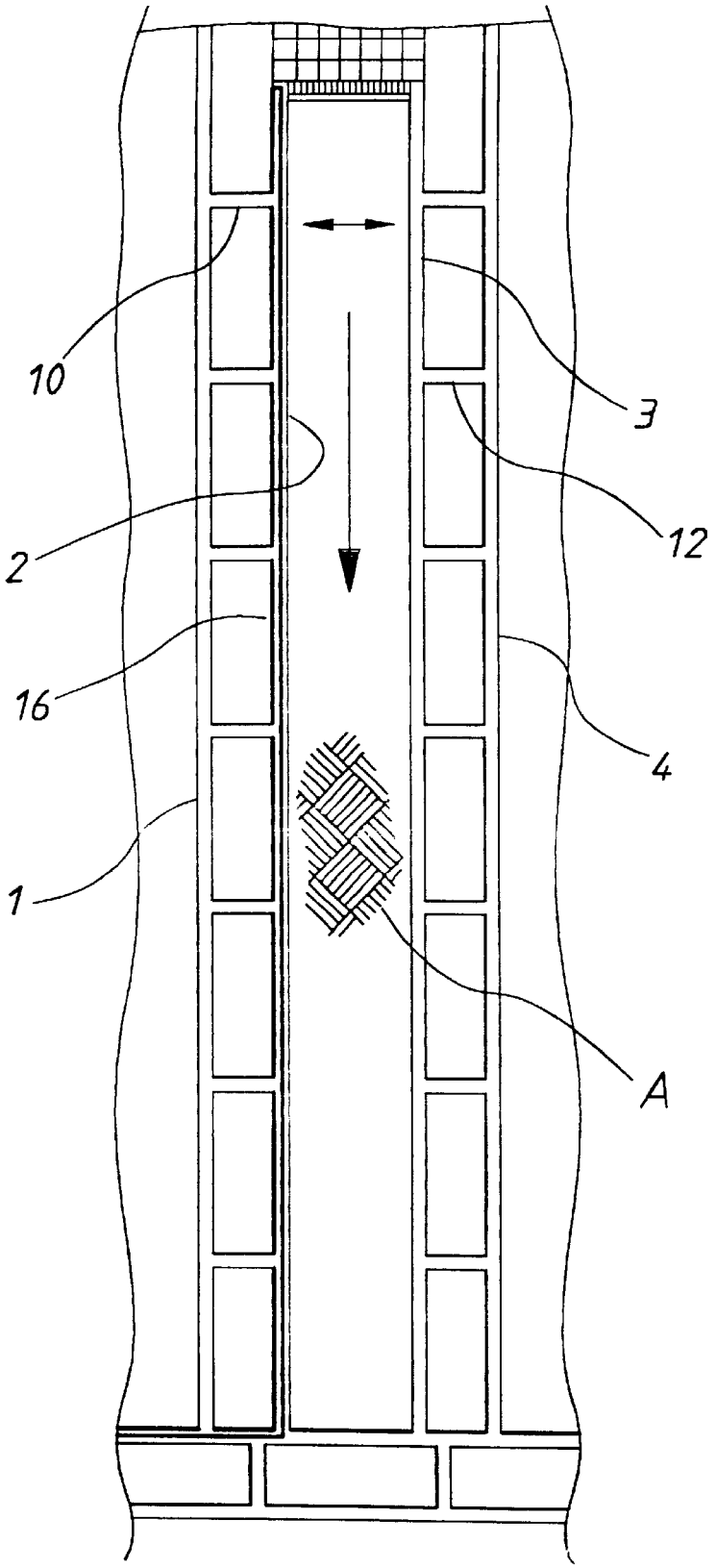
FIG. 2 is a detailed plan view of region E of FIG. 1.
Figure 3:
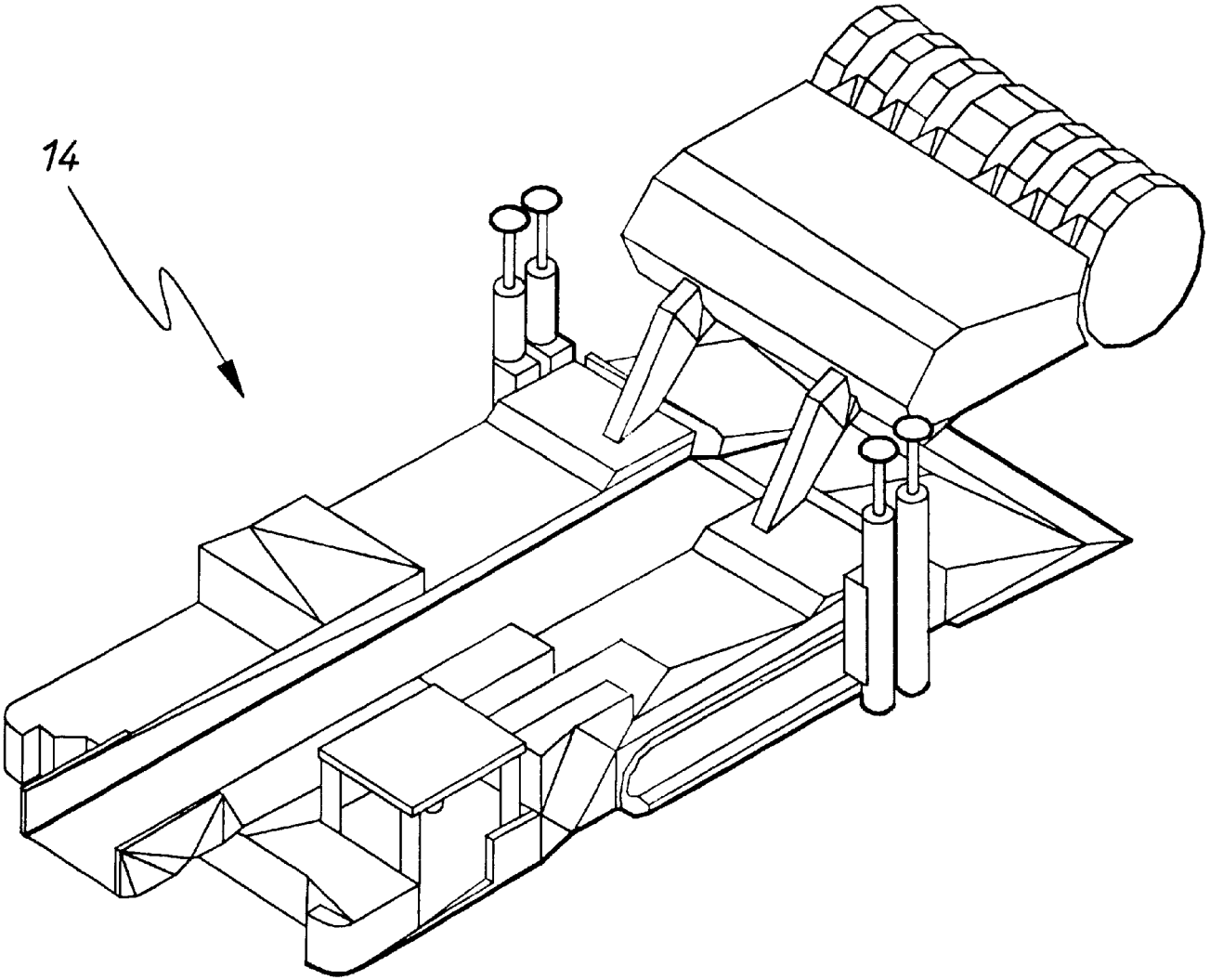
FIG. 3 is an isometric view of a continuous mining machine.
Figure 4:
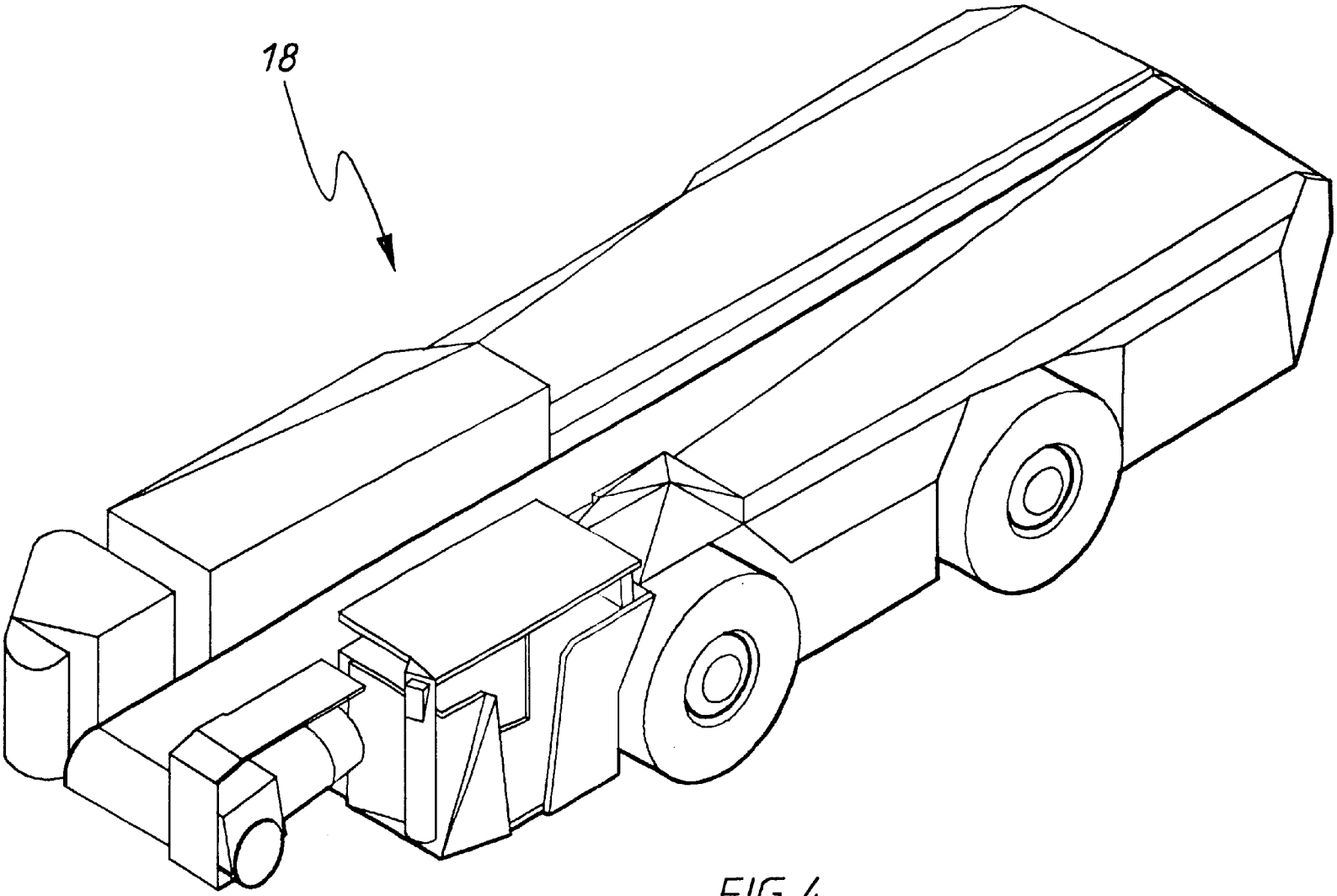
FIG. 4 is an isometric view of a shuttle car.

Referring to FIG. 2, longitudinal edges of a longitudinal block of coal A are defined by roads 2 and 3. As previously explained in the "Background of the Invention" section of the specification, roads 1 and 4 are positioned outside of roads 2 and 3 respectively. A series of equally spaced lateral roads 10 and 12 extend laterally between roads 1 and 2, and 3 and 4 respectively. As previously described, prior art methods typically used for developing roads 1–4 involves mining these roads and the lateral roads 10 and 12 with the use of a continuous mining machine (CMM). Roads 1 and 2 are developed in the same manner as roads 3 and 4. The following description will therefore refer to roads 1 and 2 only; although, it applies also to roads 3 and 4. Roads 1 and 2 are typically mined by moving a CMM 14 (see FIG. 3) from the bottom end of FIG. 2 toward the upper end of FIG. 2. As roads 1 and 2 are developed (and extend further up the page of FIG. 2), a conveyor 16 which is positioned in road 2 is periodically extended to extend further along the length of road 2. As previously described, a shuttle car (SC) 19 (see FIG. 4) is used to transport coal which has been mined by the CMM to an end of the conveyor which is closest to ends of roads 1 and 2 which are being mined.

Figure 5:
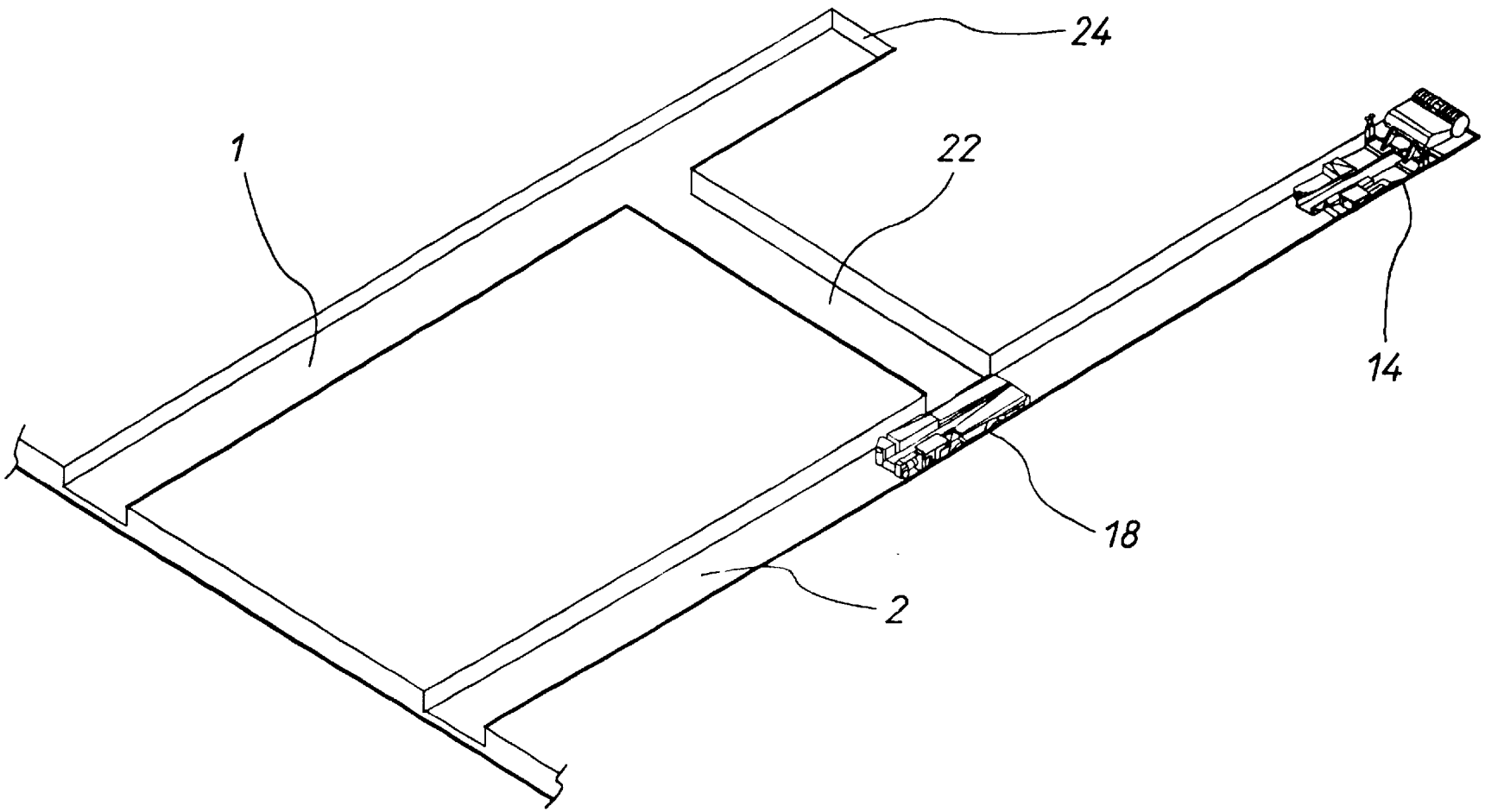
FIGS. 5 to 7 are schematic isometric views showing various stages of roadway development of roads 1 and 2 using a prior art method of roadway development.
Figure 6:
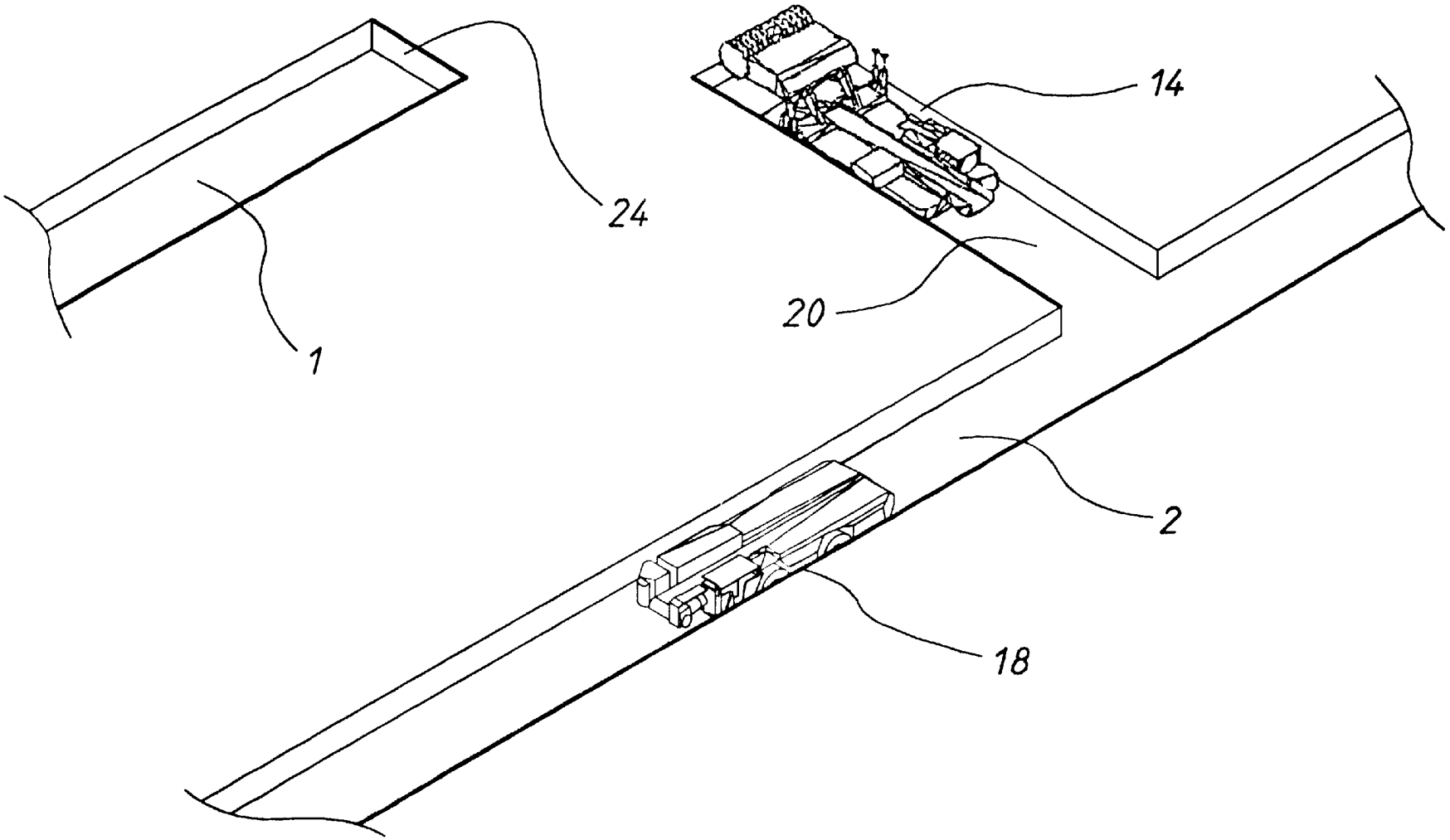
Figure 7:
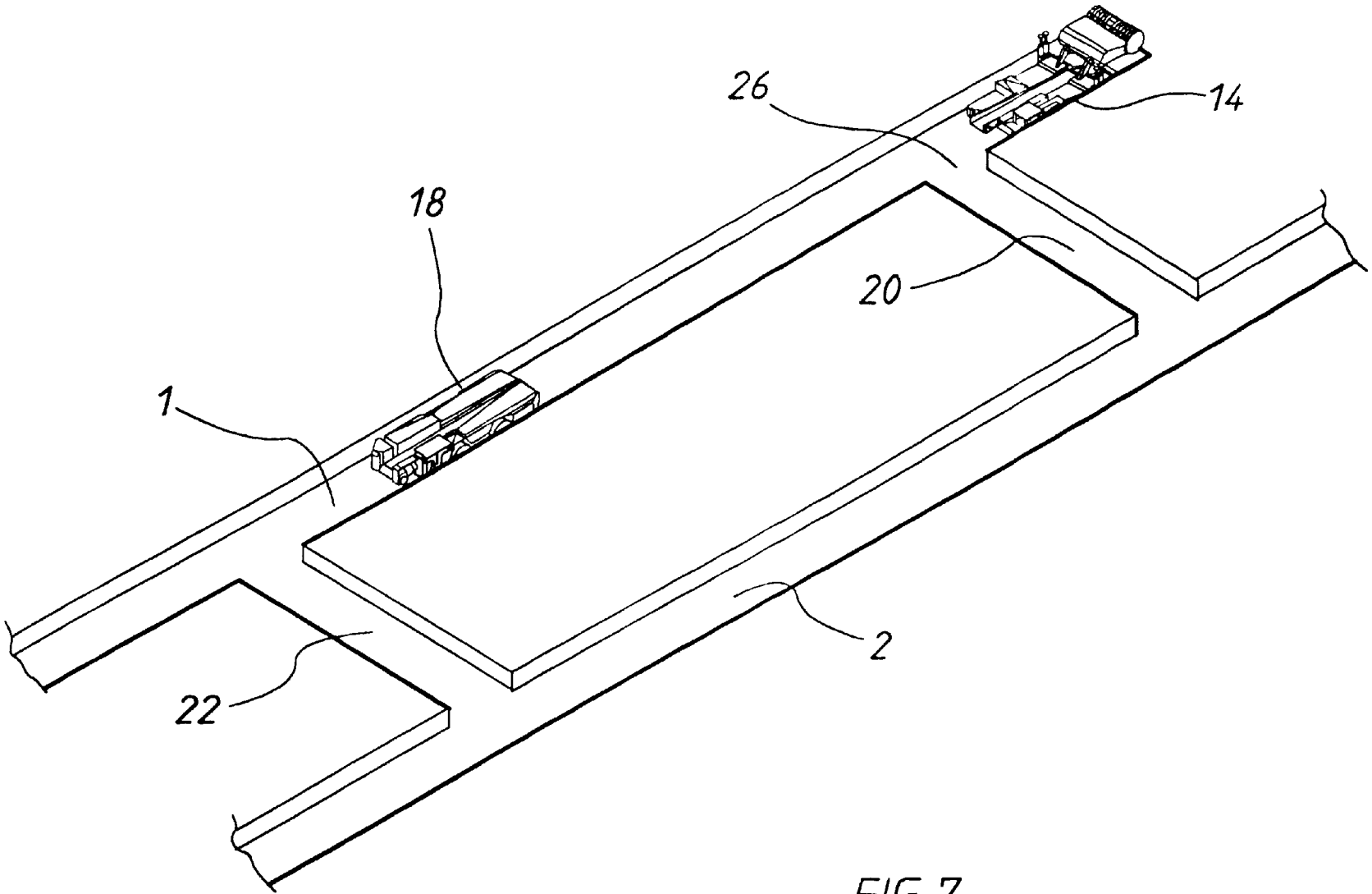

The prior art method (which differs in minor respects from the prior art method described in the "Background of the Invention" section of the specification) and associated mining equipment which is used to mine roads 1 and 2 is shown by FIGS. 5–7. Referring to FIG. 5. the length of road 2 is extended by a CMM 14. As the length of road 2 is extended by the CMM 14 the material mined in the process is transported by a SC 18 which moves frequently between the CMM 14 and a conveyor belt (CB) (not shown) which is positioned in road 2. Referring to FIG. 6, when road 2 has been extended a particular distance by the CMM 14, the CMM 14 reverses along road 2 a particular distance and subsequently turns to form a lateral road 20. After the CMM 14 has formed the lateral road 20 it reverses back along the lateral road 20 and subsequently back along road 2 until it passes another lateral road 22 (see FIGS. 5 and 7) which is closest to the lateral road 20. The CMM 14 then moves along the lateral road 20, turns into road 1 and moves along road 1 until it comes to a blind end 24 (see FIGS. 5 and 6) of road 1. The CMM 14 then mines road 1 to extend the length of road 1. As road 1 is mined it is extended beyond a blind end 26 of lateral road 20 (see FIG. 7) and after road 1 has been extended by the CMM 14 a certain distance beyond lateral road 20, the CMM 14 returns, via lateral road 20 to road 2 to repeat the above described process. The shuttle car 22 conducts frequent trips between the CMM 14 and an end of the CB (not shown) which is near the end of roads 1 and 2 which are being mined, as the CMM 14 mines roads 1, 2 and the lateral roads which join roads 1 and 2.

Figure 8:
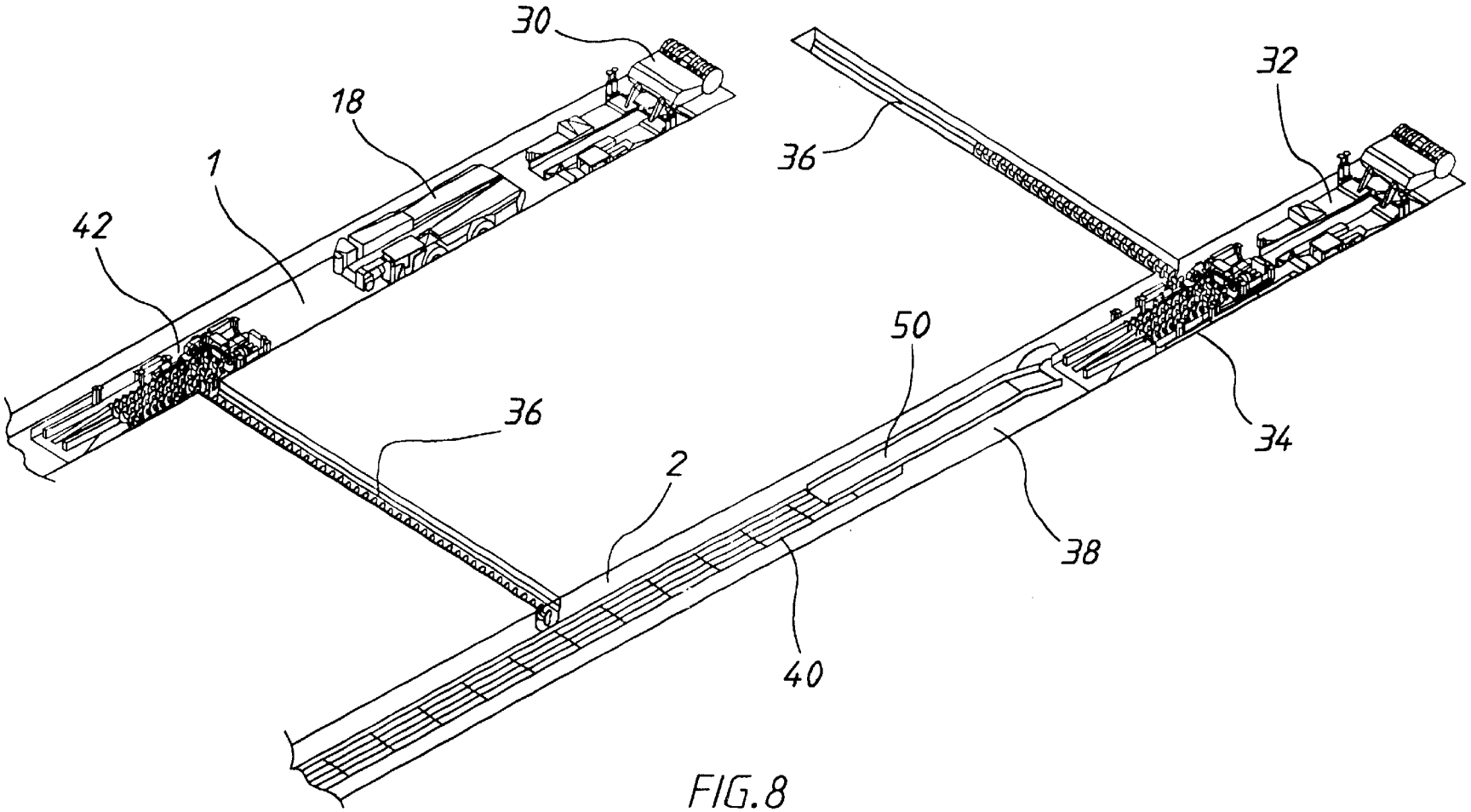
FIG. 8 is a schematic isometric viewing showing roadway development of roads 1 and 2 using a method of roadway development of the present invention.
Figure 9:
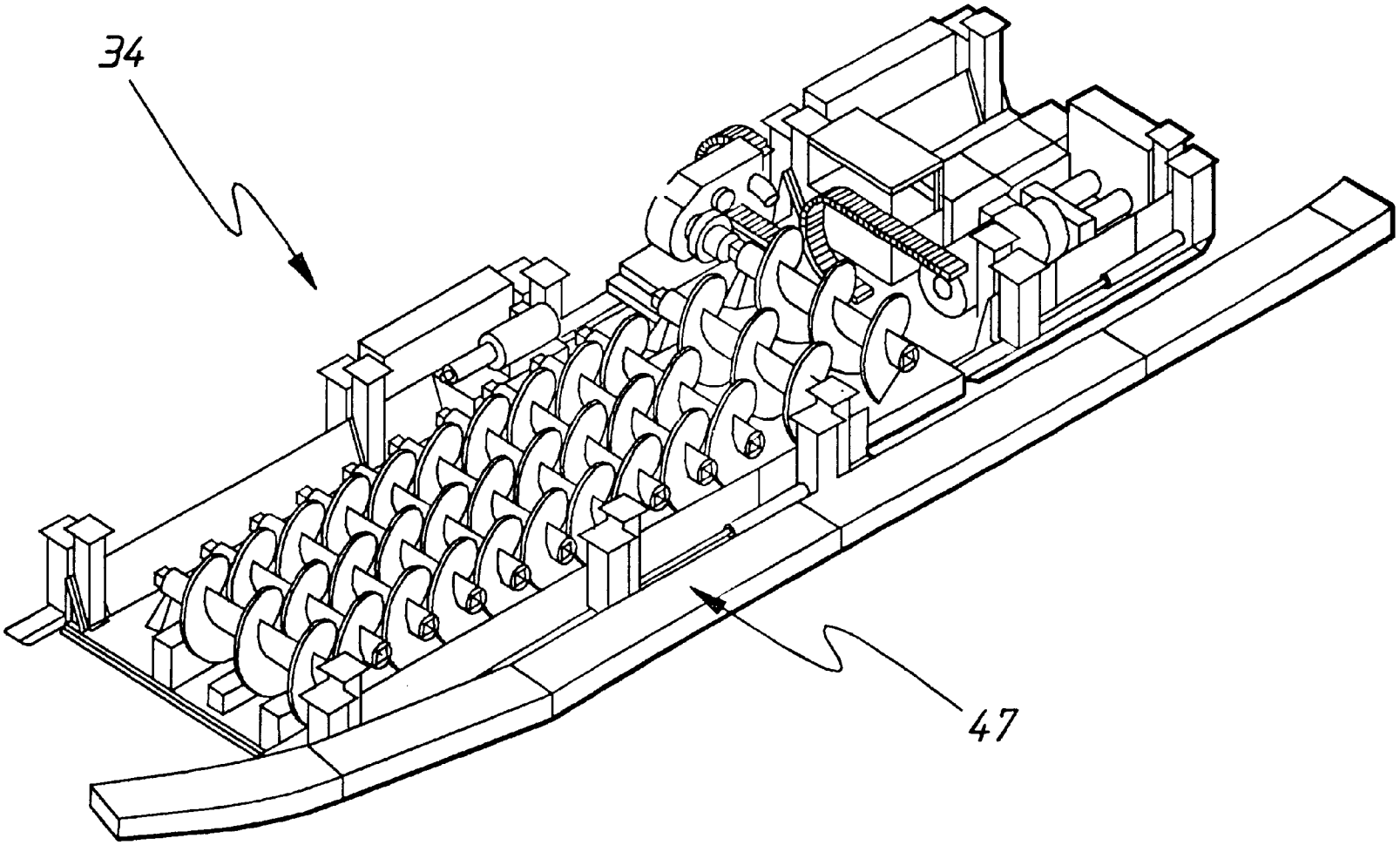
FIG. 9 is an isometric view of a roadway development auger mining machine (RDAMM)

A method, according to the present invention, by which roads 1 and 2 can be mined is described below with reference to FIG. 8. Roads 1 and 2 are mined by separate CMMs 30 and 32 respectively A roadway development auger mining machine (RDAMM) 34 (see also FIG. 9) works co-operatively with the CMM 32 and is capable of drilling lateral holes 36 which extend laterally from road 2. The lateral holes 36 provide the functional of the lateral roads of the prior art method shown in FIGS. 5 to 7, Material which is mined by the CMM 32 and RDAMM 34 is transported via a movable conveyor in the form of a dolly conveyor 38 to a stationary CB 40 which extends along the longitudinal length of road 2. The CMM 32 which mines road 2 simply moves forward to mine the blind end of road 2 and subsequently extend the length of road 2. The CMM 34 stops periodically along the length of road 2 to enable the RDAMM to periodically drill lateral holes 36 so that the lateral holes 36 are spaced apart by a predetermined distance along the longitudinal length of road 2. To enable the RDAMM to drill lateral holes 36, the CMM 32 stops for a period of time which enables assembly of an auger string by the RDAMM, drilling of a lateral hole 36, and subsequent disassembly of the auger string.

The CMM 30 similarly mines a blind end of road 1 to extend the length of road 1. The CMM's 30 and 32 are operated so that, at any given instant, the length of road 2 is longer than that road 1 so that lateral holes 36 which are drilled by the RDAMM 34 are blind holes which do not extend into road 1. However, the lateral holes 36 are drilled to a depth which is equivalent to the separation distance of roads 1 and 2. As road 1 is extended by the CMM 30 it intersects the blind end of a lateral hole 36 which results in the lateral hole 36 joining roads 1 and 2. The lateral holes 36 function as escape routes and air passage ways and are therefore typically required to be a minimum of 1.5 m in diameter. However, the lateral holes 36 also function to transport material which has been mined by the CMM 30 which is operating in road 1, road 1 through to the CB 40 which is positioned in road 2. The material mined from road 1 is transported to road 2 via a RDAMM 42 which is equivalent to the RDAMM 34 and functions to auger mined material through a lateral hole 36, rather than drill a lateral hole 36 as in the case of the RDAMM 34 of road 2. The material mined from road 1 is transported between the CMM 30 and the RDAMM 42 via a SC 18. The CB 40 is positioned below a lower surface of the lateral holes 36 so that material augered from road 1, through the lateral holes 36 is deposited onto the CB 40.

Figure 10:
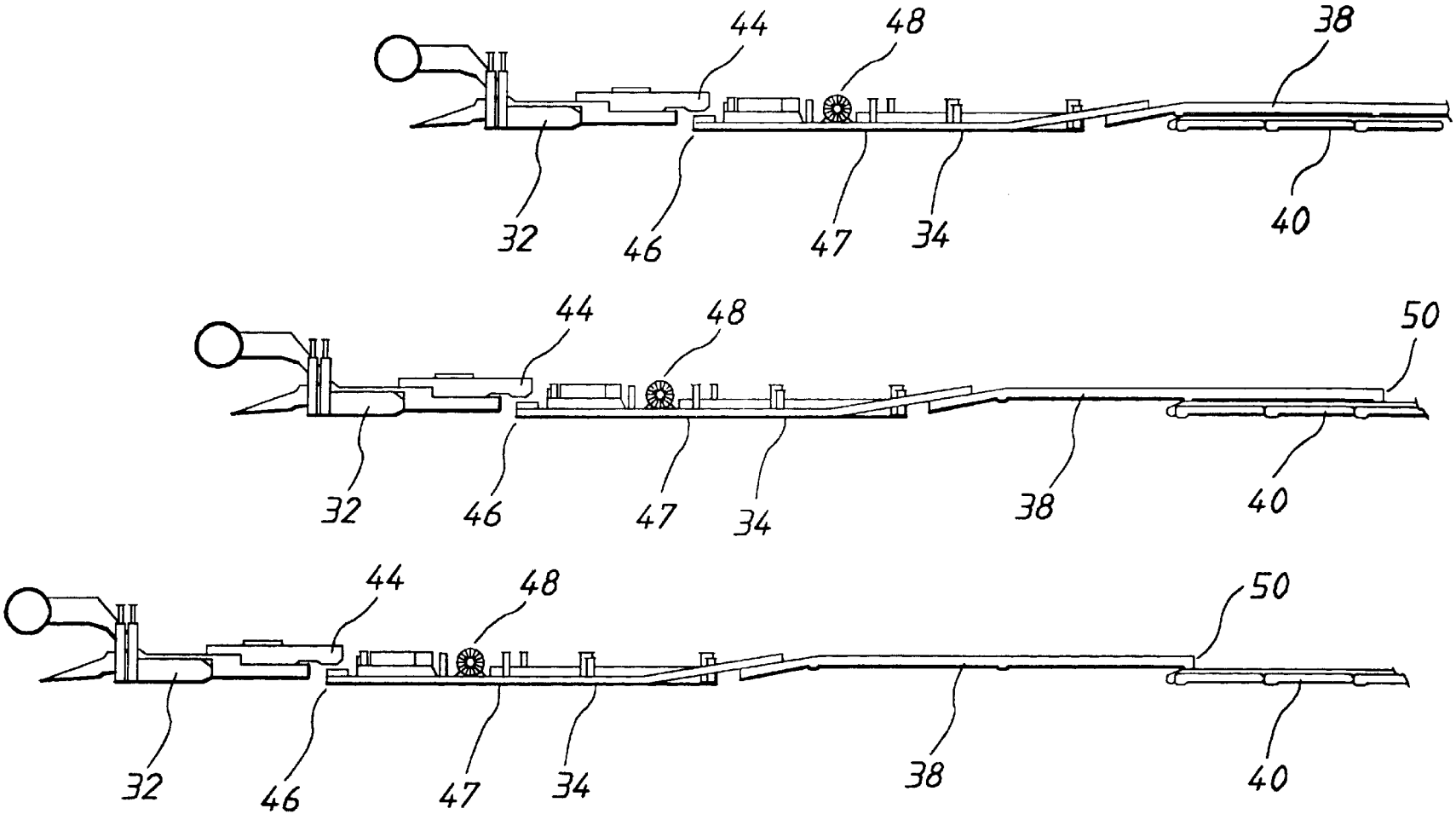
FIG. 10 is a side eleational view of a CMM and an associated RDAMM, dolly conveyor and stationary conveyor which show the amount of travel the dolly conveyor provides.

As previously described. the dolly conveyor 38 conveys mined coal which is being mined by both the CMM 32 and RDAMM 34 from the CMM 32 and RDAMM 34 respectively to the stationary CB 40. The RDAMM 34 works co-operatively with the CMM 32 and moves along the longitudinal length of road 2 with the CMM 32. Referring to FIG. 10, mined coal which has been mined from the blind end of road 2 via the CMM 32 deposits off an end 44 of the CMM 32 and onto an end 46 of an on board chain conveyor 47 (see also FIG. 9) of the RDAMM 34. Coal which has been mined by the RDAMM 34 is deposited onto the on board chain conveyor 47 near the rotating auger string 48. Rearward movement of a conveying surface (not shown) of the chain conveyor 47 moves the coal which is being mined by both the CMM 32 and RDAMM 34 rearwardly toward the dolly conveyor 38. Referring to FIGS. 8 and 10, an end 50 of the dolly conveyor 38 is positioned above an upper conveying surface of the stationary CB 40. Such relative positioning of the dolly conveyor 50 and stationary CB 40 results in mined coal being conveyed off the end 50 of the dolly conveyor and onto the upper conveying surface of the stationary CB 40. The mined coal is subsequently conveyed by the stationary CB 40 along road 2, away from the blind end of road 2 where the CMM 32 and RDAMM 34 are operating.

Movement of the dolly conveyor 38 relative to the stationary CB 40 can be seen by reference to FIG. 10. The dolly conveyor 38 works co-operatively with the CMM 32 and RDAMM 34 which develop road 2 and the lateral roads 36. Such roadway development requires the CMM 32 and attached RDAMM 34 to move along road 2, away from the stationary CB 40. Because the dolly conveyor 38 works co-operatively with the CMM 32 and RDAMM 34, it is required to move along road 2, away from the stationary CB 40. Referring to the upper elevational view of FIG. 10, the dolly conveyor 38 is initially positioned so that it is overlapping the stationary CB 40 by a maximum amount. Forward movement of the CM 32 and RDAMM 34 away from the stationary CB 40 results in the dolly conveyor 38 moving relative to the stationary CB 40. This relative movement is shown by the elevational views of FIG. 10. The middle elevational view shows the relative position of the dolly conveyor 38 and stationary CB 40 when the dolly conveyor 38 has moved relative to the stationary CB 40 a distance which is equivalent to approximately half of the maximum amount of travel of the dolly conveyor 38. The lower side elevational view of FIG. 10 shows the relative position of the dolly conveyor 38 and stationary CB 40 when the dolly CB 38 has reached the limit of its travel relative to the stationary CB 40, When the dolly conveyor 38 is positioned relative to the stationary CB 40 as shown in the lower elevational view of FIG. 10, forward movement of the CMM 32 and RDAMM 34 away from the stationary CB 40 must be suspended until the stationary CB 40 is extended along the length of road 2, toward the blind end of road 2. The stationary CB 40 is extended so that the dolly conveyor 38 is overlapping the stationary CB 40 by a maximum amount as shown in the upper elevational view of FIG. 10. The CMM 32, RDAMM 34 and dolly conveyor 38 are then able to continue to move forward and develop road 2 and the lateral holes 36.

Figure 11:
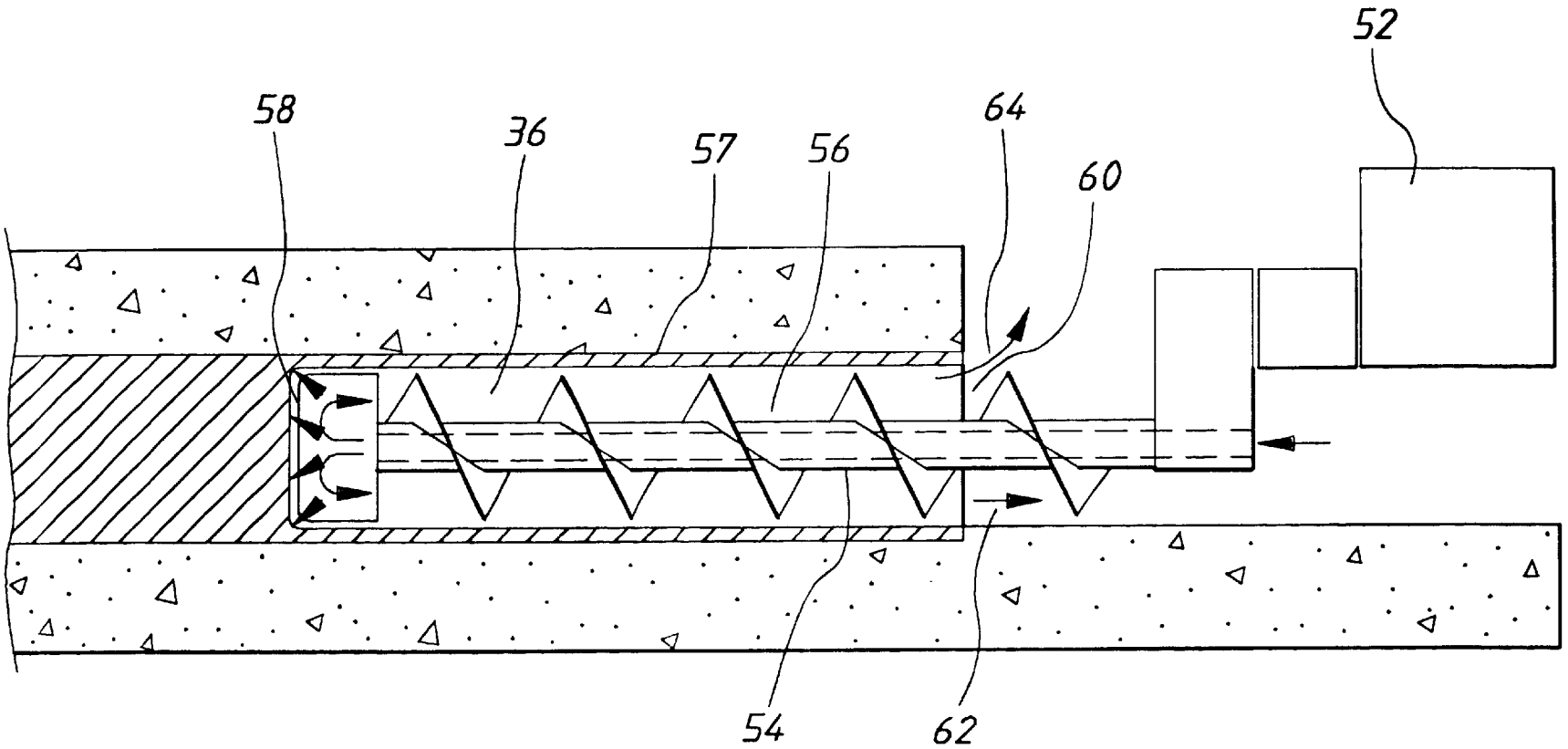
FIG. 11 is a side view of an auger string drilling into a lateral hole.

Referring to FIG. 11, the RDAMM 34 includes a pump and associated seal which enables high volume air to be pumped through the hollow stem of an assembled auger string 56 of the RDAMM 34. The air is pumped by a pump 52 into an end of the hollow stem 43 of the auger string 56. The air moves through the hollow stem 54 of the auger string 56, toward a blind end 58 of a lateral hole 36. An end of the hollow stem 54 which is adjacent a cutting head (not shown) of the auger string 56 is designed to enable the high volume air which is pumped through the hollow stem 54 of the auger string 56 to exit the hollow stem at the end which is near the cutting head (not shown). The high volume air which exits the end of the hollow stem 54 which is proximate the cutting head (not shown) fills the blind end 58 of the lateral hole 36 and moves back through the lateral hole 36, filling the space in the hole which is between the hollow stem 43 and a circumferential wall 57 which defines the lateral hole 36, toward an open end 60 of the lateral hole 36 which is proximal road 2. Arrow 62 of FIG. 11 indicates the movement of coal from an open end 60 of the lateral hole 36, while arrow 64 indicates the position from which exhaust air exits the lateral hole 36, and the general direction of movement of the exhausted air. A methanometer is attached to the RDAMM 34 to enable the concentration of methane at the open end 60 of the lateral hole 36 to be monitored. Because the concentration of methane is greatest at the open end of a hole, it is desirable that the methanometer measures the concentration of metliane as close as possible to the open end 60 of the lateral hole 36. The RDAMM 34 is designed to automatically shut down if the methane levels at the opening 60 of the lateral hole 36 reach hazardous levels. The RDAMM 34 is therefore designed to automatically shut down if the methane levels at the open end 60 of the lateral hole 36 are not less than 2%.

Figure 12:
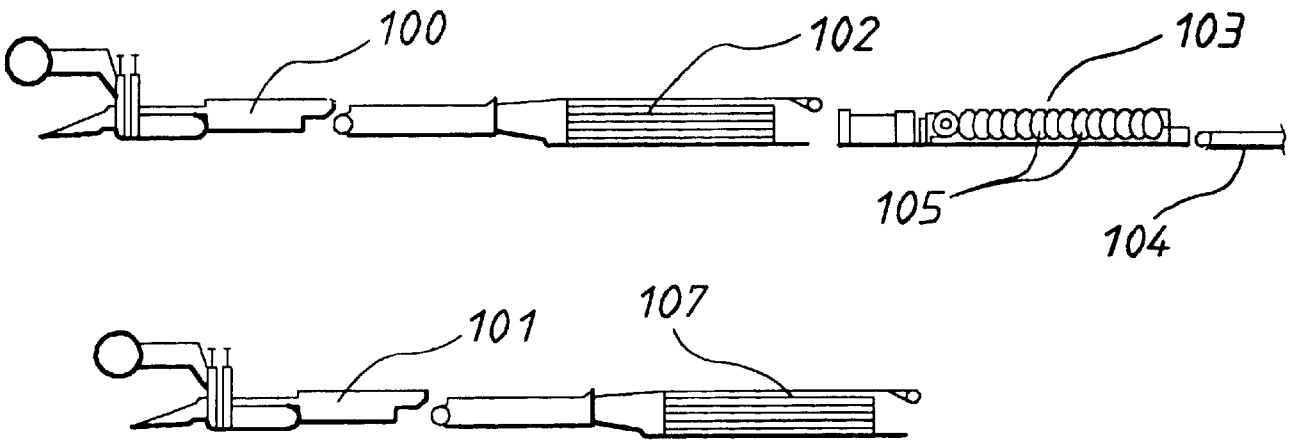
FIG. 12 is a schematic illustration of a pair of continuous mining machines and associated conveyors to develop generally parallel co-extensive roads for longwall mining.
Figure 13:
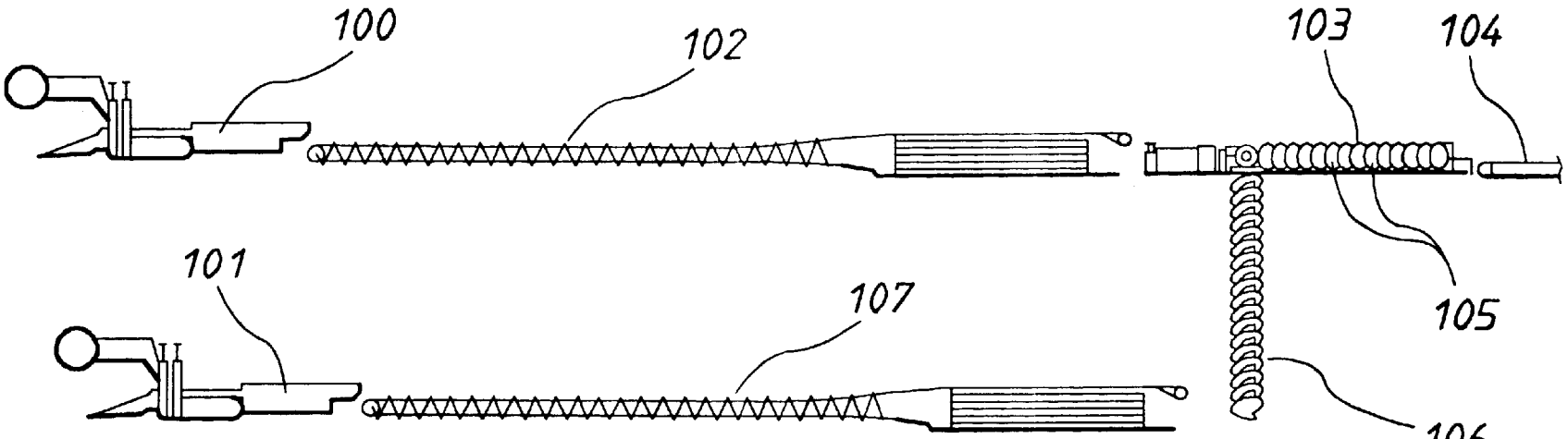
FIG. 13 is a schematic illustration of the miners of FIG. 12 and associated conveyors.

In FIGS. 12 and 13, there are schematically depicted continuous mining machines 100 and 101. The machines 100 and 101 would form a pair of parallel roads as previously discussed, that is, roads used in longwall mining.

The continuous mining machine 100 has extending rearwardly from it a first conveyor 102 which is extendable in length as the machine 100 progresses to form a road. That is, as the machine 100 progresses, the conveyor 102 extends longitudinally to convey mined coal rearwardly from the machine 100. At the rear extremity of the conveyor 102, is a roadway development auger mining machine 103 which receives the mined material from the conveyor 102 and delivers it to a further conveyor 104. Typically the conveyor 104 would deliver the mined material to a position at which the mined material exits the roadway. The machine 100 includes auger segments 105 which are linked to form a transverse auger conveyor 106 which not only forms a tunnel within which it is located but also conveys material from the parallel roadway formed by the machine 101.

Extending rearwardly from the machine 101 is a conveyor 107 which is substantially of the same construction as the conveyor 102 and is progressively elongated as the machine 101 progresses to form the roadway. The conveyor 107 delivers material to the auger 106 so that the material mined by the machine 101 is delivered to the machine 103 where from it is delivered to the conveyor 104.

When the conveyors 102 and 107 have reached their elongated limits, the auger 106 is retracted and dismantled into its various segments. The conveyors 102 and 107 are contracted by moving in a direction towards the machines 100 and 101. The machine 103 is then moved towards the machine 100 an appropriate distance, and a further transverse tunnel formed by rotation of the auger segments 105 as they are incrementally stacked to form the auger 106. The machine 103 may be incrementally moved so that a plurality of transverse tunnels are formed. When the conveyors 102 and 107 have reached their contracted limits, the last tunnel formed would contain the auger 106 and the process repeated.

Figure 14:
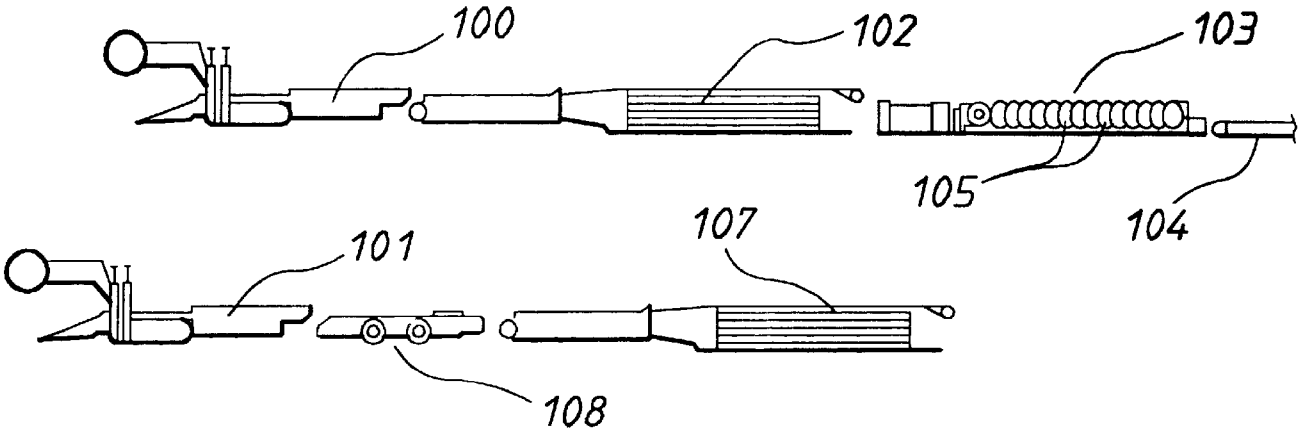
FIG. 14 is a schematic illustration of a pair of continuous miners and associated conveyors.
Figure 15:
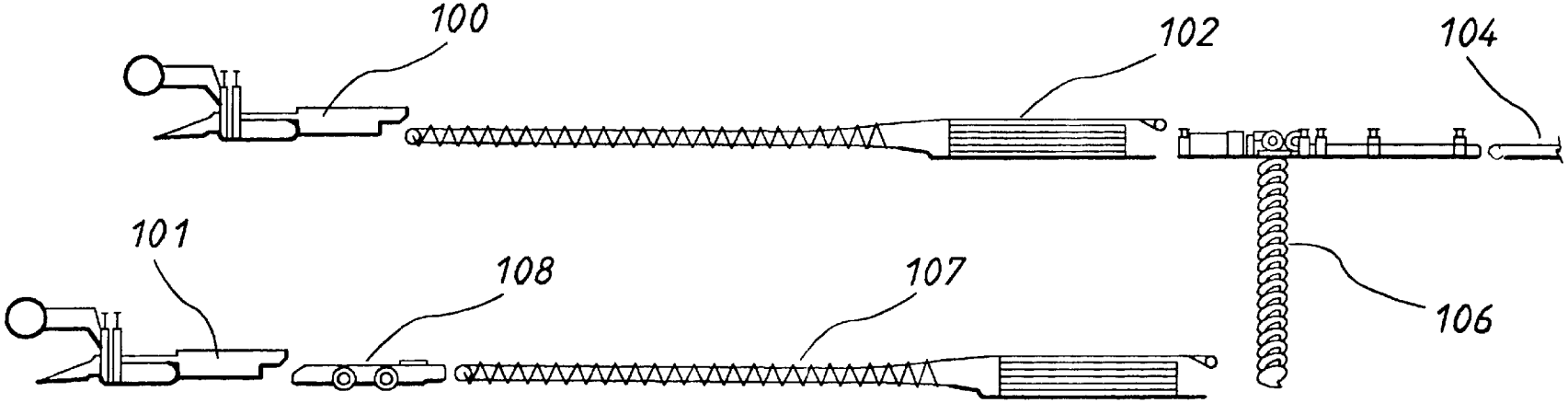
FIG. 15 is a schematic illustration of the miners and conveyors of FIG. 14.

In the embodiment of FIGS. 14 and 15, a shuttle car 108 is interposed between the machine 101 and the conveyor 107. In this embodiment, the mined material produced by the machine 101 is conveyed to the conveyor 107 by the shuttle car 108.

Figure 16:
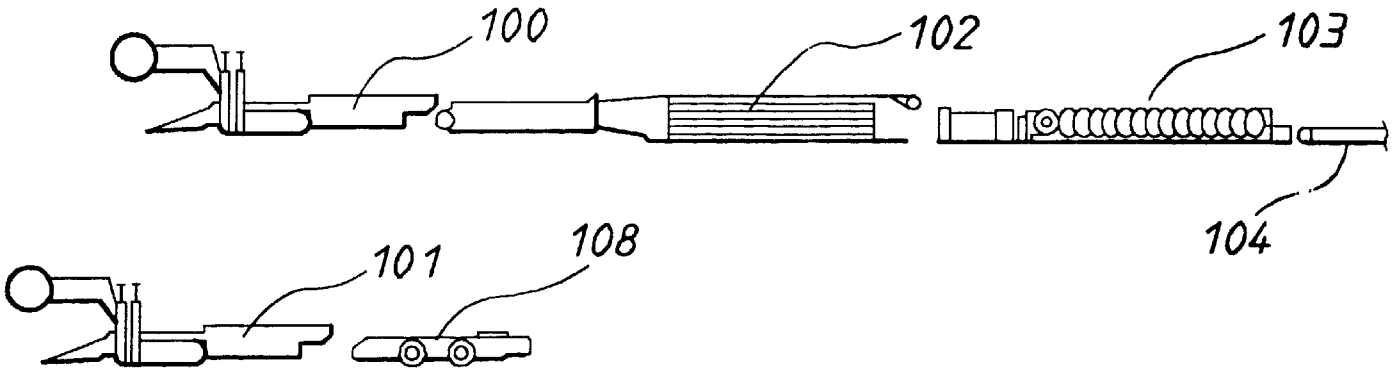
FIG. 16 is a schematic illustration of a pair of continuous mining machines and associated conveyors.
Figure 17:
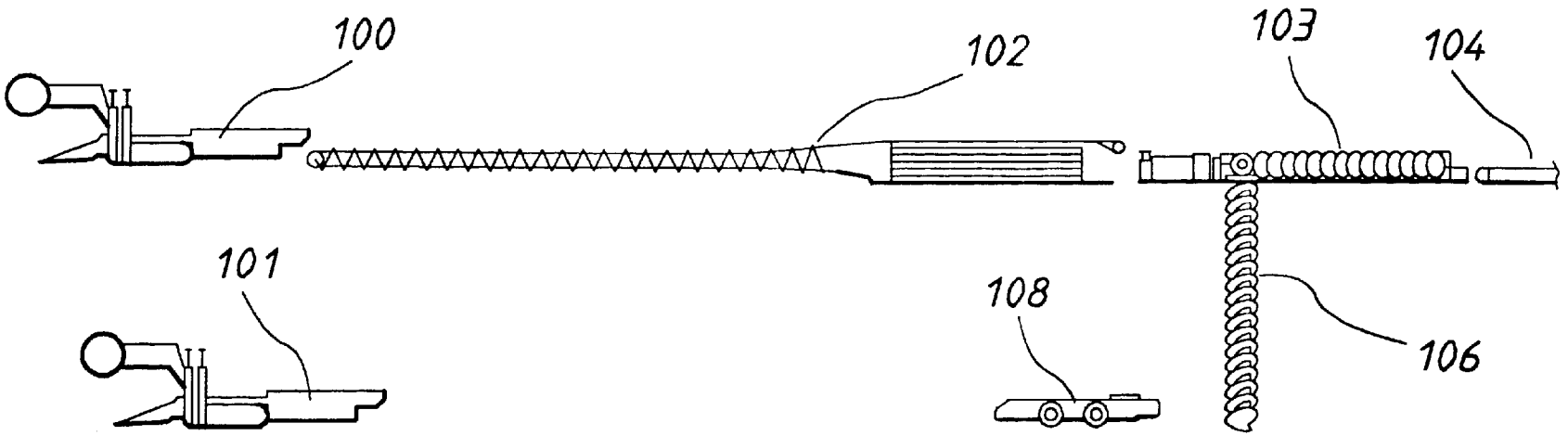
FIG. 17 is a schematic illustration of the miners of FIG. 16 and associated conveyors.

In the embodiment of FIGS. 16 and 17, the shuttle car 108 has been maintained but the conveyor 107 eliminated.

Figure 18:
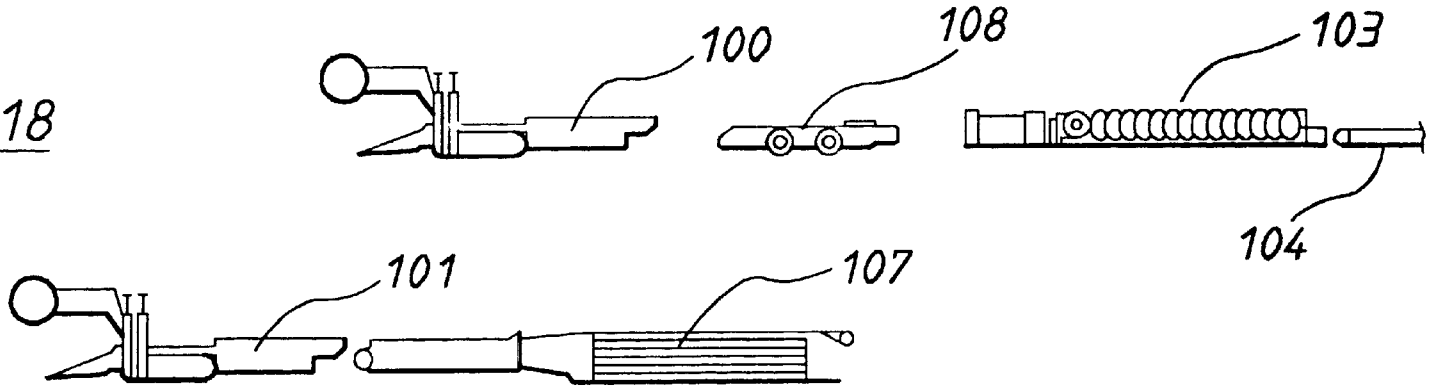
FIG. 18 is a schematic illustration of a pair of continuous miners and associated conveyors.
Figure 19:
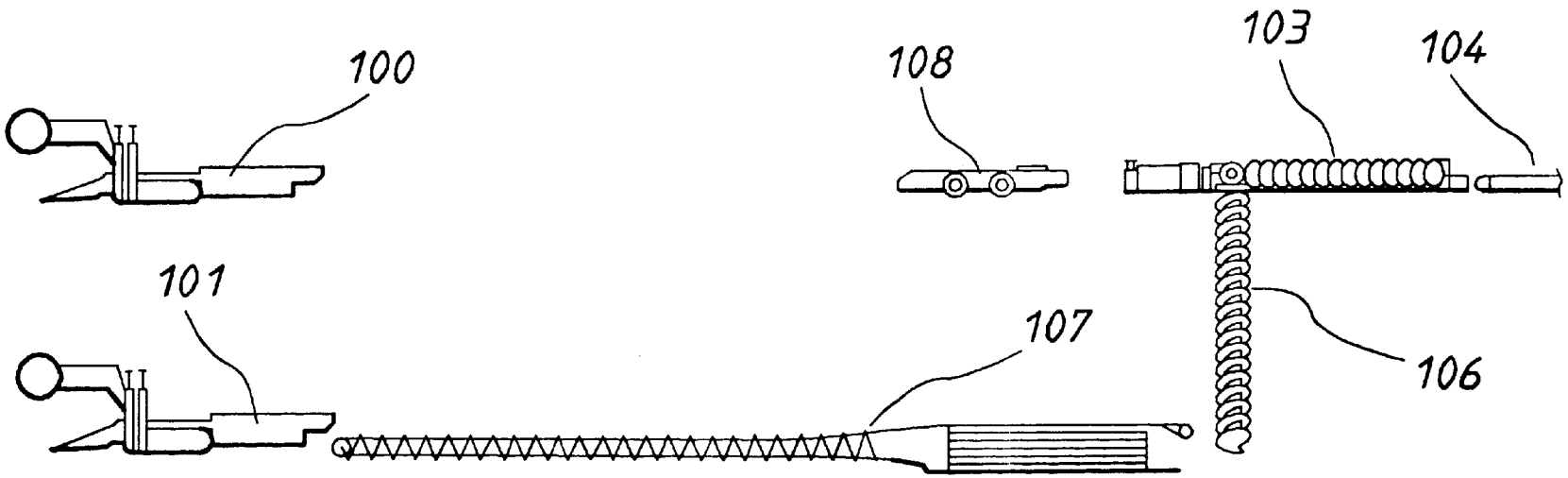
FIG. 19 is a schematic illustration of the continuous miners and conveyors of FIG. 18.

In the embodiment of FIGS. 18 and 19, the conveyor 107 is employed without an associated shuttle car, but the conveyor 102 replaced with the shuttle car 108.

Figure 20:
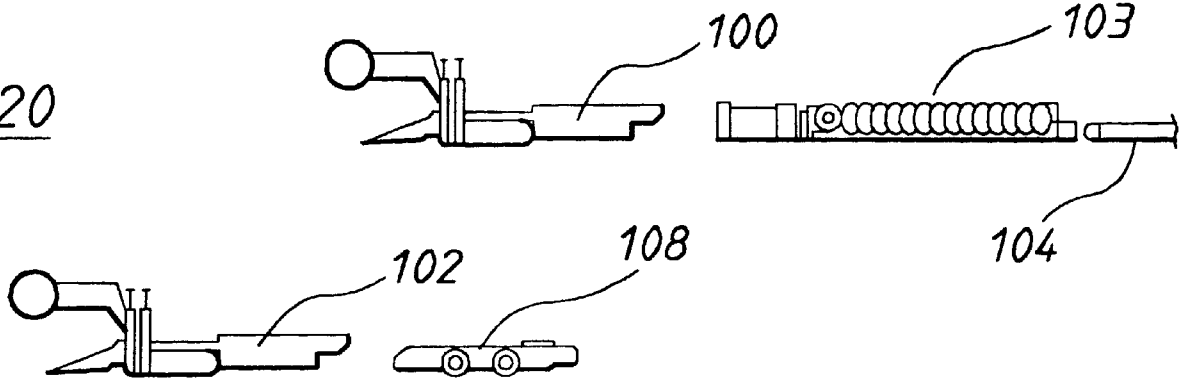
FIG. 20 is a schematic illustration of a pair of continuous miners and associated conveyors.
Figure 21:
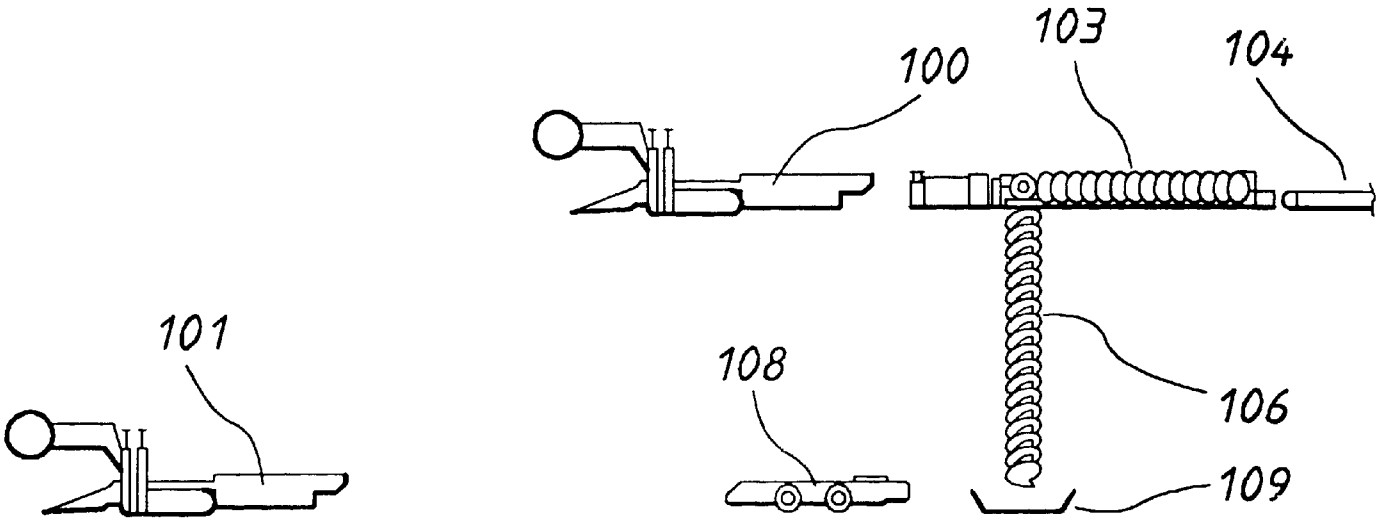
FIG. 21 is a schematic illustration of the continuous miners and conveyors of FIG. 20.

In the embodiment of FIGS. 20 and 21, both conveyors 102 and 107 are eliminated but the shuttle car 108 employed in respect of the machine 101. Mined material from the machine 100 would be delivered directly to the machine 103. The shuttle car 108 would deposit mined material in a hopper 109 from where the mined material would be transversely conveyed to the machine 103 by the auger 106.

The claims defining the invention are as follows:

1. A method of roadway development for longwall mining comprising developing a first road by use of a first continuous mining machine;

delivering mined material from the first machine to a first longitudinally extendable first conveyor extending rearwardly from the first machine;

delivering the material from the first conveyor to a second conveyor via which mined material from the first road is delivered from the first road, developing a second road by use of a second continuous mining machine, the second road being substantially parallel to the first road;

delivering the mined material from the second machine to a longitudinally extendable third conveyor extending rearwardly from the second machine, delivering the mined material from the third conveyor to a transverse auger conveyor extending between the first and second roads so that mined material from the third conveyor is delivered to the second conveyor.

2. The method of claim 1 wherein a shuttle car conveys material from the second continuous miner to the third conveyor.

3. The method of claim 2 wherein the auger conveyor is provided by an auger mining machine via which material is conveyed to the second conveyor and to which mined material is delivered from the first and second mining machines.

4. The method of claim 1 wherein the auger conveyor is provided by an auger mining machine via which material is conveyed to the second conveyor and to which mined material is delivered from the first and second mining machines.

5. A method of roadway development for longwall mining comprising:

developing a first road by use of a first continuous mining machine;

delivering mined material from the first machine to a first longitudinally extendable first conveyor extending rearwardly from the first machine;

delivering the material from the first conveyor to a second conveyor via which mined material from the first road is delivered from the first road;

developing a second road by use of a second continuous mining machine, the second road being substantially parallel to the first road;

delivering the mined material from the second machine to a shuttle car;

delivering the mined material from the shuttle car to a transverse auger conveyor extending between the first and second roads so that mined material from the shuttle car is delivered to the second conveyor.

6. The method of claim 5 wherein the auger conveyor is provided by an auger mining machine via which material is conveyed to the second conveyor and to which mined material is delivered from the first and second mining machines.

7. A method of roadway development for longwall mining comprising:

developing a first road by use of a first continuous mining machine;

delivering mined material from the first machine to a shuttle car;

delivering the material from the shuttle car to a first conveyor via which mined material from the first road is delivered from the first road;

developing a second road by use of a second continuous mining machine, the second road being substantially parallel to the first road;

delivering the mined material from the second machine to a longitudinally extendable second conveyor extending rearwardly from the second machine;

delivering the mined material from the second conveyor to a transverse auger conveyor extending between the first and second roads so that mined material from the second conveyor is delivered to the first conveyor.

8. A The method of claim 7 wherein the auger conveyor is provided by an auger mining machine via which material is conveyed to the first conveyor and to which mined material is delivered from the first and second mining machines.

9. A method of roadway development for longwall mining comprising:

developing a first road by use of a first continuous mining machine;

delivering mined material from the first machine to a first conveyor;

developing a second road by use of a second continuous mining machine, the second road being substantially parallel to the first road;

delivering mined material from the second mining machine by an auger conveyor to said first conveyor; and the material from said second mining machine being delivered to said auger conveyor by means of a shuttle car.

10. The method of claim 9 wherein the auger conveyor is provided by an auger mining machine, to which material from said first machine is directly delivered to be conveyed to the first conveyor.

* * * * *